US006887053B2

(12) United States Patent
Eiermann

(10) Patent No.: US 6,887,053 B2
(45) Date of Patent: May 3, 2005

(54) ROTARY PISTON ENGINE IN TROCHOIDAL DESIGN

(75) Inventor: Dankwart Eiermann, Weissensberg (DE)

(73) Assignee: Brandenburgische Forschungs- und Entwicklungsgesellschaft mbH, Cottbus (DE)

( * ) Notice: Subject to any disclaimer, the term of this patent is extended or adjusted under 35 U.S.C. 154(b) by 0 days.

(21) Appl. No.: 10/265,648

(22) Filed: Oct. 8, 2002

(65) Prior Publication Data

US 2003/0217730 A1 Nov. 27, 2003

(30) Foreign Application Priority Data

Oct. 10, 2001 (DE) ..... 101 51 639

(51) Int. Cl.[7] ..... F01C 1/02; F01C 1/22

(52) U.S. Cl. ..... 418/61.2; 418/61.1; 418/60; 29/888.012

(58) Field of Search ..... 123/241, 240, 123/200, 237, 238; 418/61.2, 61.1, 60, 178; 29/888.012

(56) References Cited

U.S. PATENT DOCUMENTS

| | | | | |
|---|---|---|---|---|
| 3,259,115 A | * | 7/1966 | Bensinger et al. | 418/60 |
| 3,288,118 A | * | 11/1966 | Abermeth | 418/61.2 |
| 3,883,273 A | * | 5/1975 | King | 418/60 |
| 3,903,847 A | * | 9/1975 | Olenzek et al. | 418/60 |
| 3,913,198 A | * | 10/1975 | Ernest et al. | 29/888.012 |
| RE29,806 E | * | 10/1978 | Iida et al. | 418/178 |
| 4,729,726 A | * | 3/1988 | Kurio et al. | 418/60 |
| 4,729,729 A | * | 3/1988 | Tarumoto et al. | 418/178 |
| 6,481,989 B2 | * | 11/2002 | Eiermann | 418/61.2 |

FOREIGN PATENT DOCUMENTS

| | | | | |
|---|---|---|---|---|
| DE | 40 03 633 A1 | | 8/1990 | |
| DE | 40 03 663 A1 | * | 8/1991 | 418/61.2 |

* cited by examiner

*Primary Examiner*—Thai-Ba Trieu
(74) *Attorney, Agent, or Firm*—Crowell & Moring LLP

(57) ABSTRACT

In a rotary piston engine in trochoidal design with a rotor housing, made of light metal, and with side parts, which are made of light metal, it is provided that the bearing bodies are connected in an area, in which the maximum gas pressures develop, by means of tie rods, which are oriented radially in relation to the bearing body, to a support element, which rests externally on the side parts and the rotor housing.

21 Claims, 7 Drawing Sheets

ROTARY PISTON ENGINE IN TROCHOIDAL DESIGN

This application claims the priority of Patent Document No. 101 51 639.8, filed in Germany on Oct. 10, 2001, the disclosure of which is expressly incorporated by reference herein.

BACKGROUND AND SUMMARY OF THE INVENTION

The invention relates to a rotary piston engine in trochoidal design with a rotor housing, made of light metal, and with side parts, which are made of light metal and in which bearing bodies are installed to receive an eccentric shaft.

Many variants of mass-produced rotary piston engines exist, an example of which is given in DE 40 03 663 C. Usually they comprise side parts made of gray cast iron and held together with the trochoidally shaped rotor housing by means of axial tie rods. All forces between the side parts and the rotor housing are transferred between the adjoining surfaces by means of friction lock. This friction lock is produced by pre-stressing the axial tie rods. The bearing bodies for the bearings of the eccentric shaft are designed usually like a flange and are fastened to the side parts by means of axially oriented screws.

To achieve an optimal weight to power ratio for the engine and to provide additionally for good heat dissipation at high power output, the side parts can be made of light metal, in particular of an aluminum alloy. In known engines of this design and in particular in engines with supercharge operating mode and charge stratification, the mechanical problems are greater. After a relatively short operating time, the side parts crack. In addition, the rotor housing shifted radially in relation to the side parts. The application of higher axial pre-stresses does not lead to satisfactory results, because with the use of aluminum components the results are inadmissibly high material stresses and thus additional problems. Even the use of greater material thicknesses does not lead to satisfactory results, because the dissipation of heat becomes worse and the weight is increased.

The invention is concerned with the problem of designing a light metal rotary piston engine of the type described in the introductory part in such a manner that a high structural strength and thus high operational safety are achieved.

This problem is solved in that the bearing bodies are held in an area, in which the maximum gas pressures develop, by at least one tie rod. The tie rod is oriented approximately radially to the bearing body and is connected to a support element, which rests externally on the side parts and the rotor housing.

The use of tie rods results in high structural strength at relatively low weight increase. In addition, a connection, which is shape locking in the radial direction, is produced between the rotor housing and the side parts, where the housing forces and the bearing forces are transferred substantially to the tie rods. The axial screw couplings must be pre-stressed only to the extent that the sealing function is reliably fulfilled.

In an exemplary design of the invention, two tie rods are provided for each bearing body, of which one is disposed approximately in the plane of symmetry of the rotor housing and the other, at an angle ranging from approximately 30 degrees to approximately 45 degrees in the rotational direction of the plane of symmetry. Thus the area of maximum gas pressures is reinforced in an adequate manner.

In an advantageous design of the invention tension bolts, extending through the side parts, are provided as the tie rods.

To this end high strength steel screws can be used. The bearing bodies and the support elements are made of gray cast iron or steel so that they exhibit a significantly higher structural strength than aluminum.

Another design of the invention provides that the bearing bodies exhibit a partially cylindrical outer surface and are held on the counter-surfaces of the side parts by the tie rods. The result is ample clearance for the bearing and rotor cooling oil to drain inside the side parts.

Other objects, advantages and novel features of the present invention will become apparent from the following detailed description of the invention when considered in conjunction with the accompanying drawings.

DETAILED DESCRIPTION OF THE DRAWINGS

Figure 1:
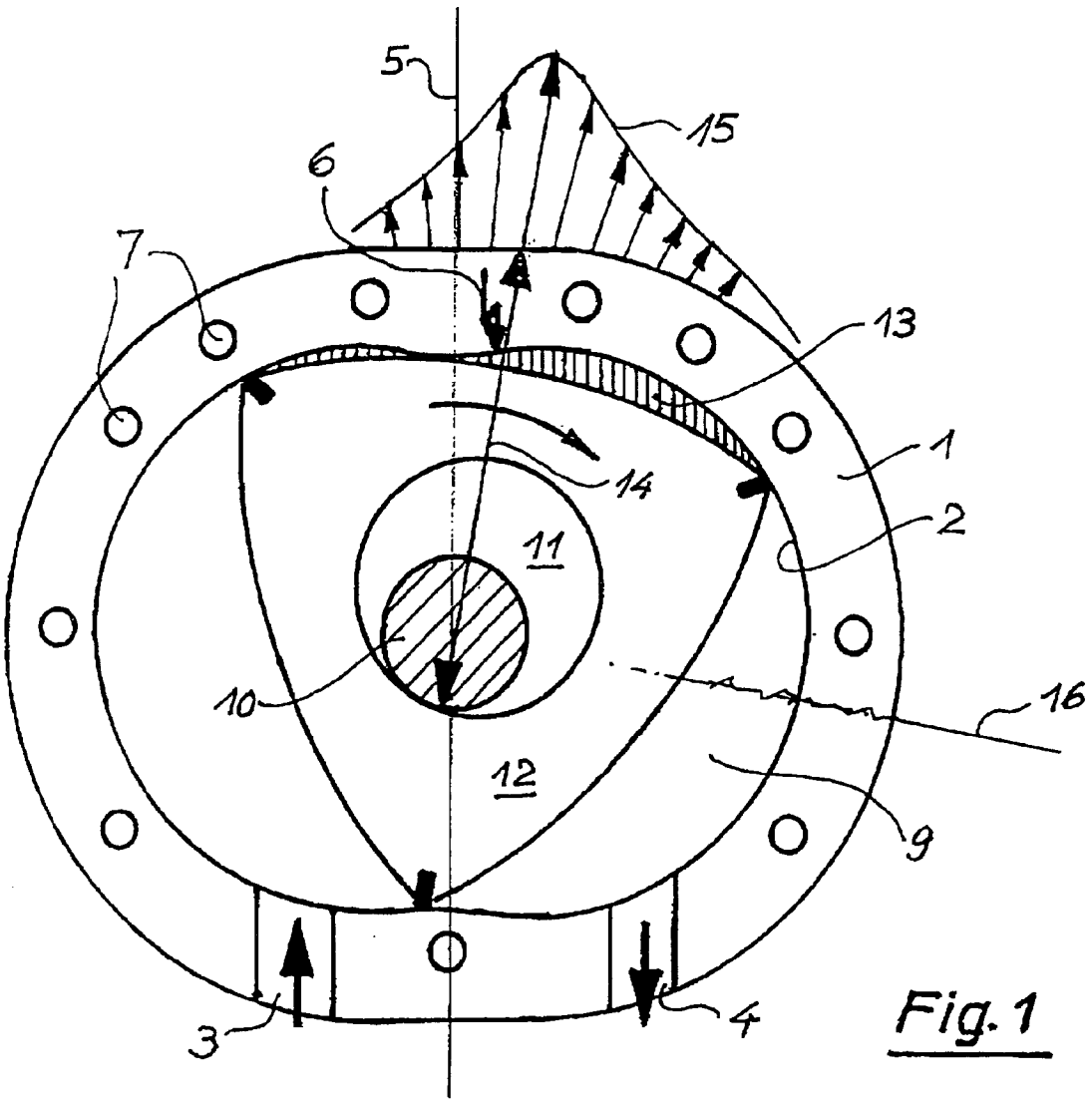
FIG. 1 is a schematic drawing of a trochoidal rotary piston engine design with a characteristic line of the maximum gas pressures.

The rotary piston engine, depicted in FIG. 1, has a rotor housing 1, which is made of an aluminum die casting or shell cast aluminum and has a two-lobed, trochoidal track 2. The rotor housing 1 has an inlet opening 3 and an outlet opening 4, as well as an ignition source 6 in the area of the plane of symmetry in the area near the axis.

Two side parts 8, 9, which are also made of light metal and in particular an aluminum alloy as die castings or shell castings, are connected to the rotor housing 1 by means of axial tension bolts 7. An eccentric shaft 10 is disposed so as to slide in the side parts 8, 9. This eccentric shaft 10 exhibits an eccentric 11, on which a triangular piston rotor 12 is mounted that is positioned in a known manner by means of synchronizing teeth.

In FIG. 1 the piston rotor 12, which rotates clockwise, is shown in a position, in which approximately the maximum gas pressure is generated in a combustion chamber 13. The existing force directions are indicated by a double arrow 14. These forces act between the mounting of the eccentric shaft 10 and the rotor housing 1. Outside the rotor housing 1 the curve 15 of the gas pressure at different positions of the piston rotor 12 and the eccentric shaft 10 is shown with arrows in the area of the upper dead center. The result of the acting forces is that the maximum material stresses that are the reason for the formation of cracks develop in the side parts 8 and 9 in the area of the line 16 at approximately 90 degrees from the force indicated by the double arrow 14 in the direction of rotation.

Figure 3:
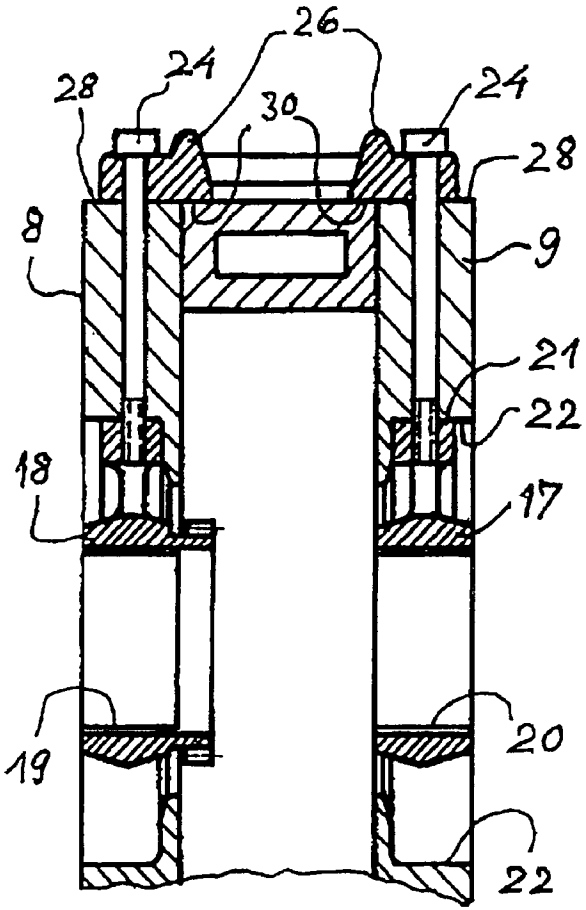
FIG. 3 is a view along the line III—III of FIG. 2.
Figure 2:
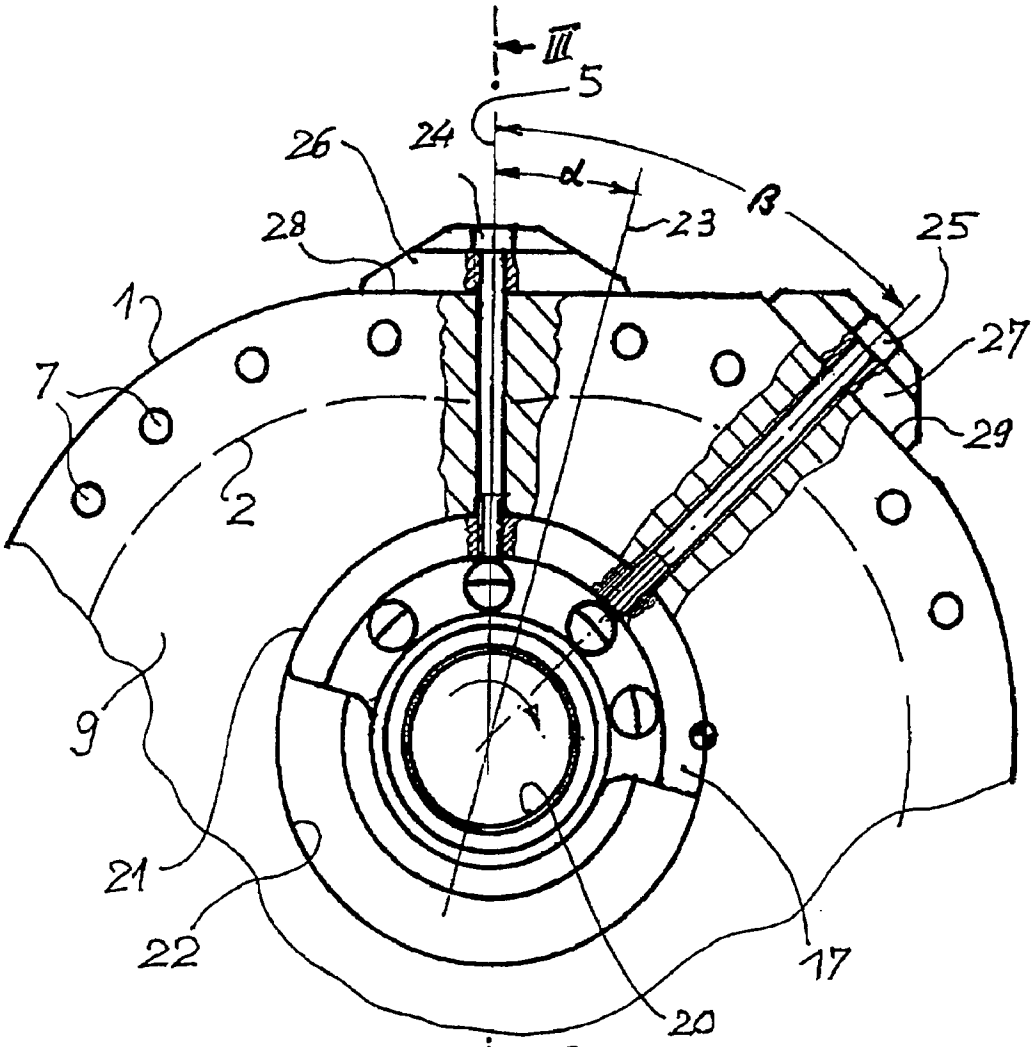
FIG. 2 is a partially cut view of a side part with a bearing body and tie rods.

As shown in FIGS. 2 and 3, bearing bodies 17 and 18, which accommodate the friction bearing inserts 19, 20 for the eccentric shaft 10, are disposed in the side parts 8, 9. The bearing bodies 17, 18 comprise an internal closed ring, which receives the friction bearing inserts 19, 20, and an external partially cylindrical ring 21, which is approximately semi-cylindrical in the embodiment, according to FIG. 2. With this semi-cylindrical ring 21, the bearing bodies 17, 18 are disposed in cylindrical recesses 22 of the side parts 8, 9. Since the recess 22 is not completely filled and the web between the internal rings of the bearing bodies 17, 18 and the partially cylindrical outer ring 21 is provided with passages, the results are extensive draining spaces for bearing and rotor cooling oil inside the side parts. The line of symmetry 23 of the outer rings 21 is staggered about 10 degrees to about 20 degrees in the direction of rotation in relation to the plane of symmetry 5 of the rotor housing 1.

The bearing bodies 17, 18 are connected by tension bolts 24, 25, which penetrate the side parts 8, 9 and are directed radially in the outward direction, to support elements 26, 27, which rest against the contact surfaces 28, 29 of the side parts and which also extend over the contact surfaces 30 of the rotor housing 1 and rest against them. The support elements 26, 27 of the opposing side parts 8, 9 are connected together by webs.

As evident from FIG. 2, the tension bolts 24 of the two side parts 8, 9 run radially in the plane of symmetry 5 of the rotor housing 1. The second tension bolts 25 are offset by an angle ranging from about 30 degrees to about 45 degrees in the engine's direction of rotation. In the embodiment, according to FIGS. 2 and 3, the contact surfaces 28, 29 and 30 are aligned at least approximately tangentially to the axis of the bearing bodies 17, 18.

Figure 4:
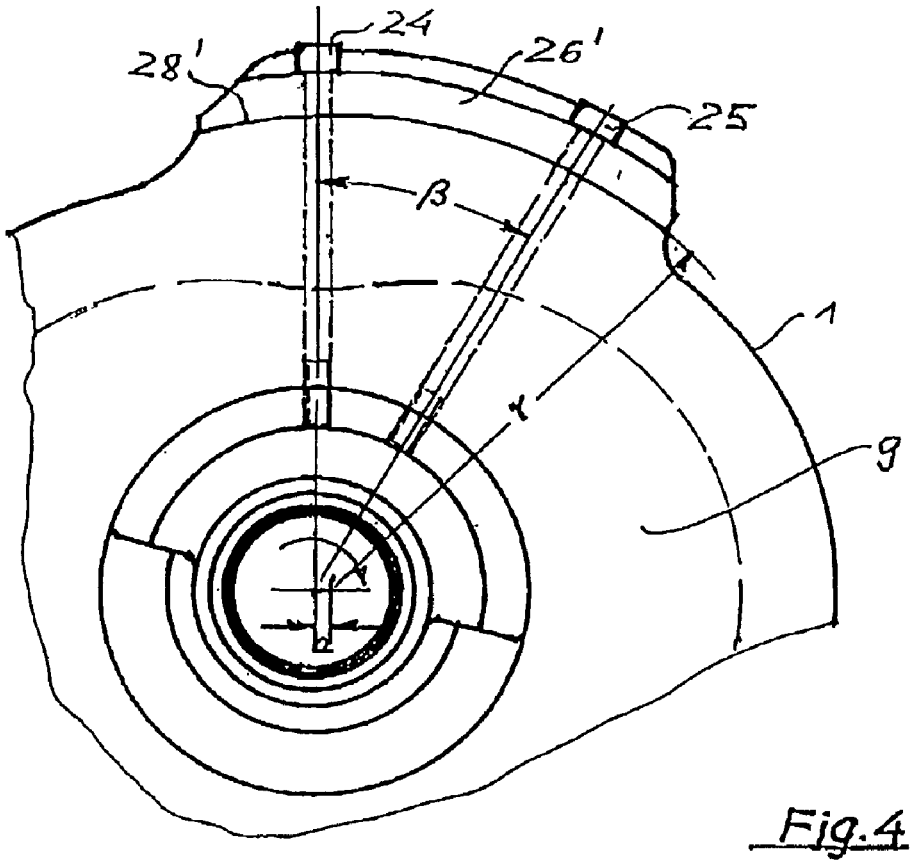
FIG. 4 is a side view similar to FIG. 2 of another embodiment.

In the embodiment, according to FIG. 4, common support elements 26' are provided for the tension bolts 24, 25 of the side parts 8, 9. The common contact surface 28' to the side parts as well as the invisible common contact surface to the rotor housing 1 do not run completely concentrically to the axis of the eccentric shaft, but rather are offset by a distance a in the direction of the expansion side (hot lobe) of the bearing housing 1 and the side parts 8, 9. The radius r of the support surfaces 28' to the side parts 8, 9 and to the rotor housing is somewhat greater than the radius in the remaining area.

Figure 5:
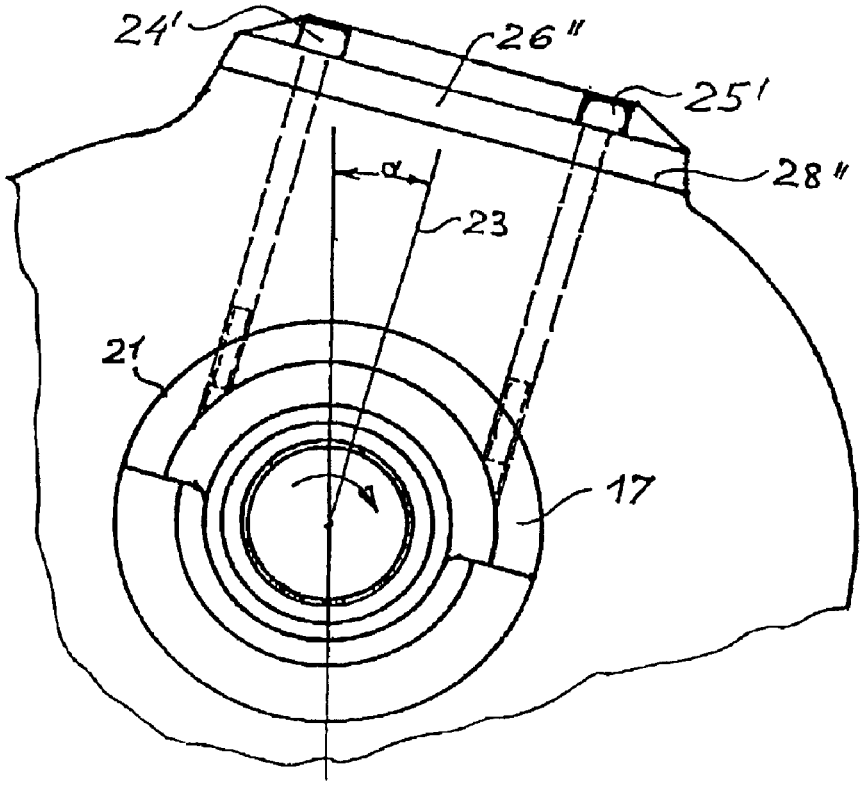
FIG. 5 is a side view similar to FIG. 2 of an embodiment with parallel tie rods.

In the embodiment, according to FIG. 5, there is also a common support element 26" for the tension bolts 24' and 25'. In this embodiment the contact surfaces 28" run in essence tangentially to the axis of the bearing bodies 17, 18. In this embodiment the tie rods 24, 25' are designed only approximately radially, that is, they run parallel to each other and parallel to the radial line of symmetry 23 of the outer rings of the bearing bodies 17, 18.

Figure 6:
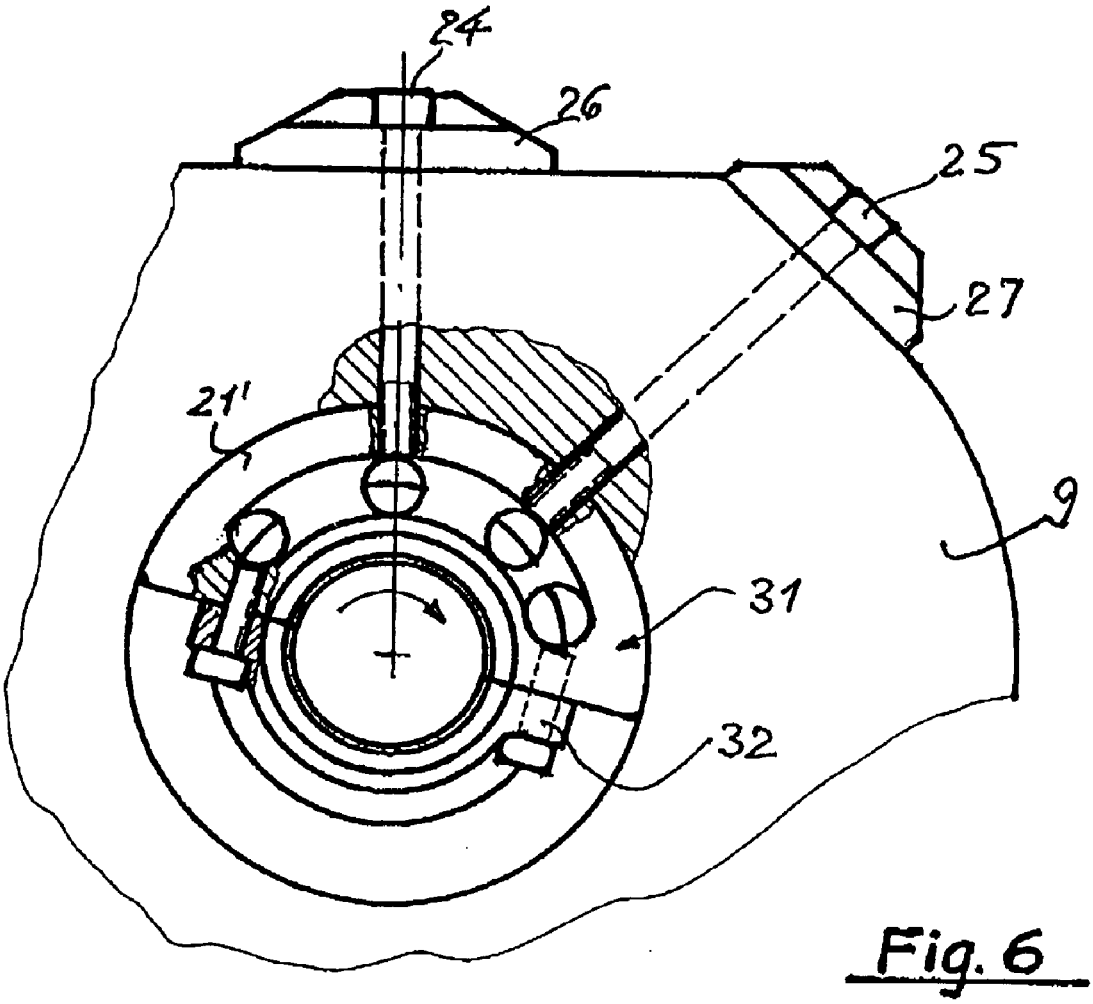
FIG. 6 is a side view similar to FIG. 2 with divided bearing bodies.

FIG. 6 depicts an embodiment, which is especially suitable for multi rotor engines with one eccentric shaft and especially for the bearing body 31, which are to be arranged then centrally. The bearing body 31 may be divided into two parts, one part that is provided with the outer ring 21', receiving the tension bolts 24, 25, and a second opposing part 32. The two parts of the bearing body 31 are connected together with screws.

Figure 7:
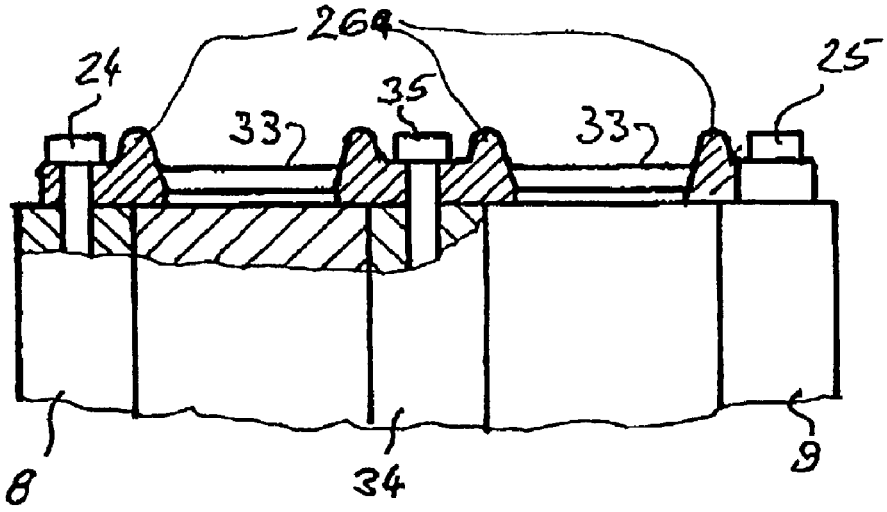
FIG. 7 is a partially cut view of a rotary piston engine designed with multiple rotors.
Figure 8:
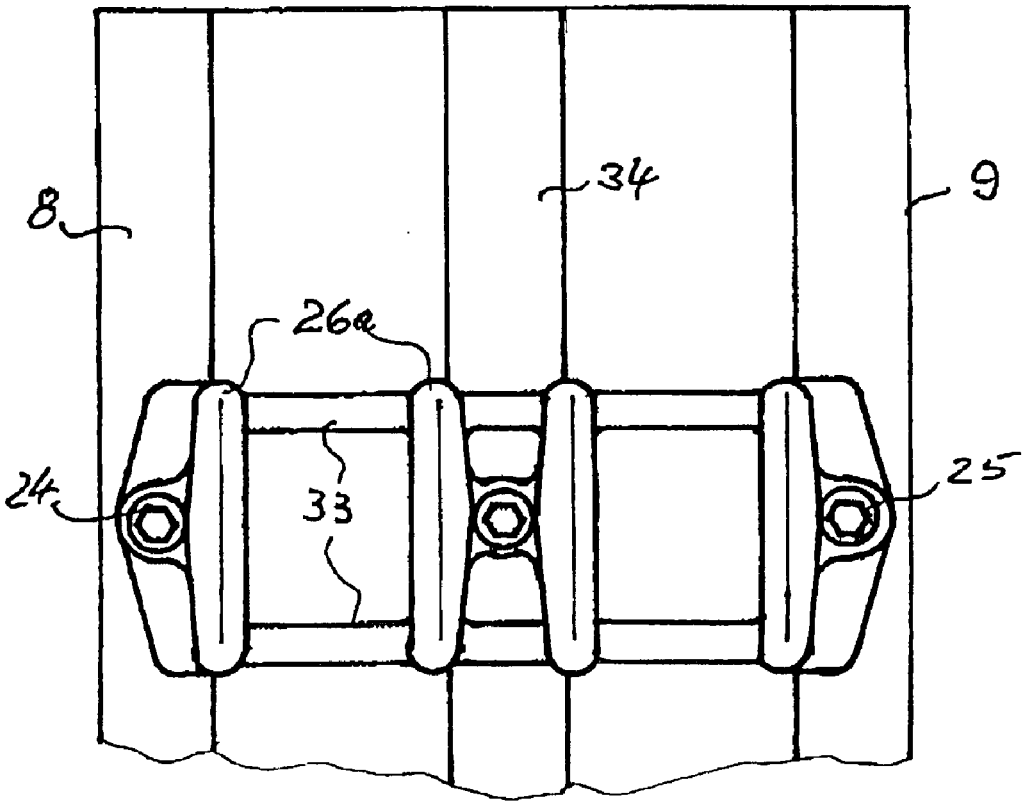
FIG. 8 is a partial top view of the embodiment of FIG. 7.

FIGS. 7 and 8 indicate a multi rotor engine, in which a common support element 26*a*, which receives the corresponding tension bolts 24, 25 and 35, is provided for the two outer side disks 8, 9 and a central side disk 34. The individual parts of this support element 26*a* are connected together by webs 33, which run in the axial direction and which are arranged at a distance from the external sides of the rotor housing.

Figure 9:
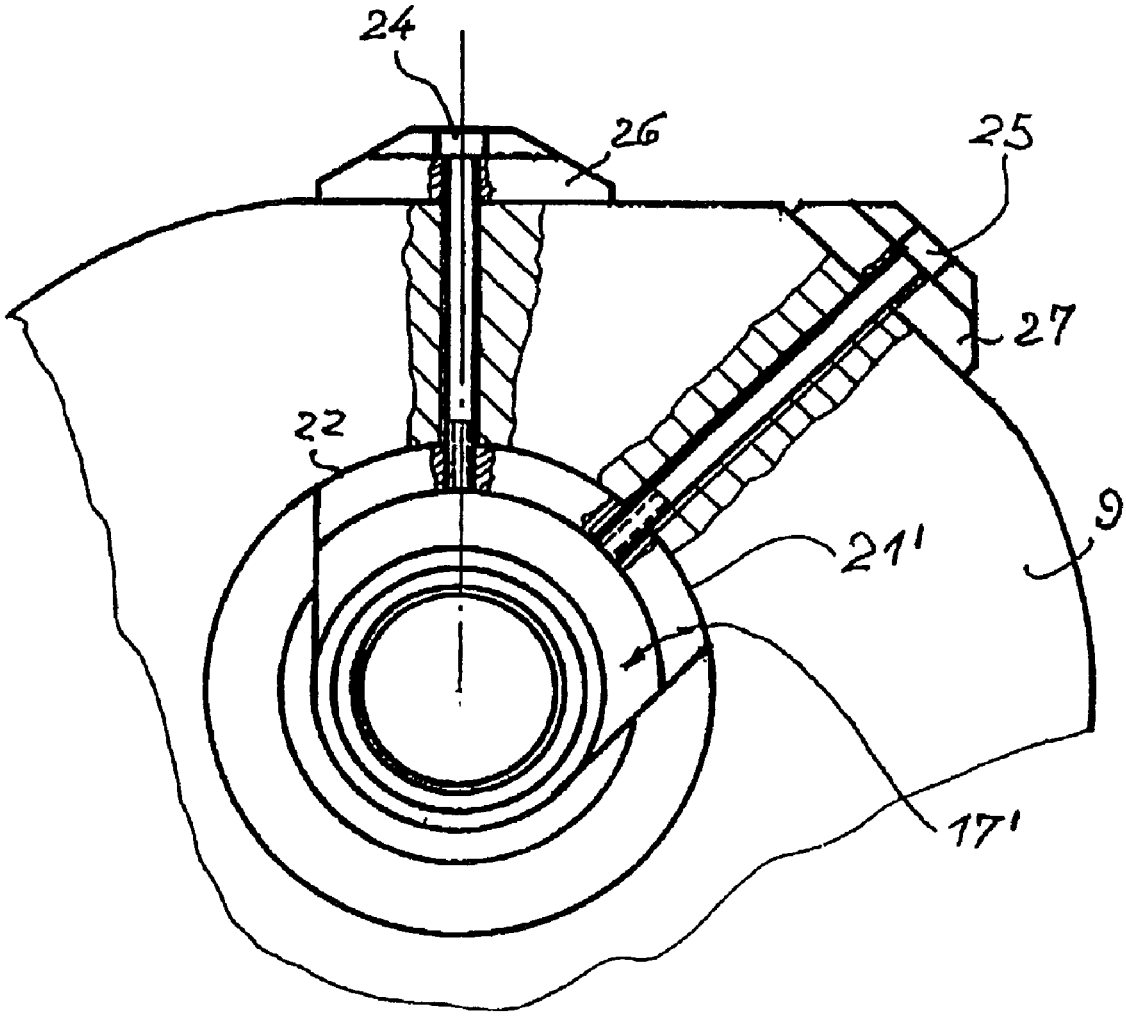
FIG. 9 is a view similar to FIG. 2 of an embodiment with a bearing body, whose size is decreased.

FIG. 9 depicts an embodiment, in which the bearing carrier body 17' is provided with an outer ring 21', which extends only over approximately one-third of the recess 22 in the side parts 8, 9.

Figure 10:
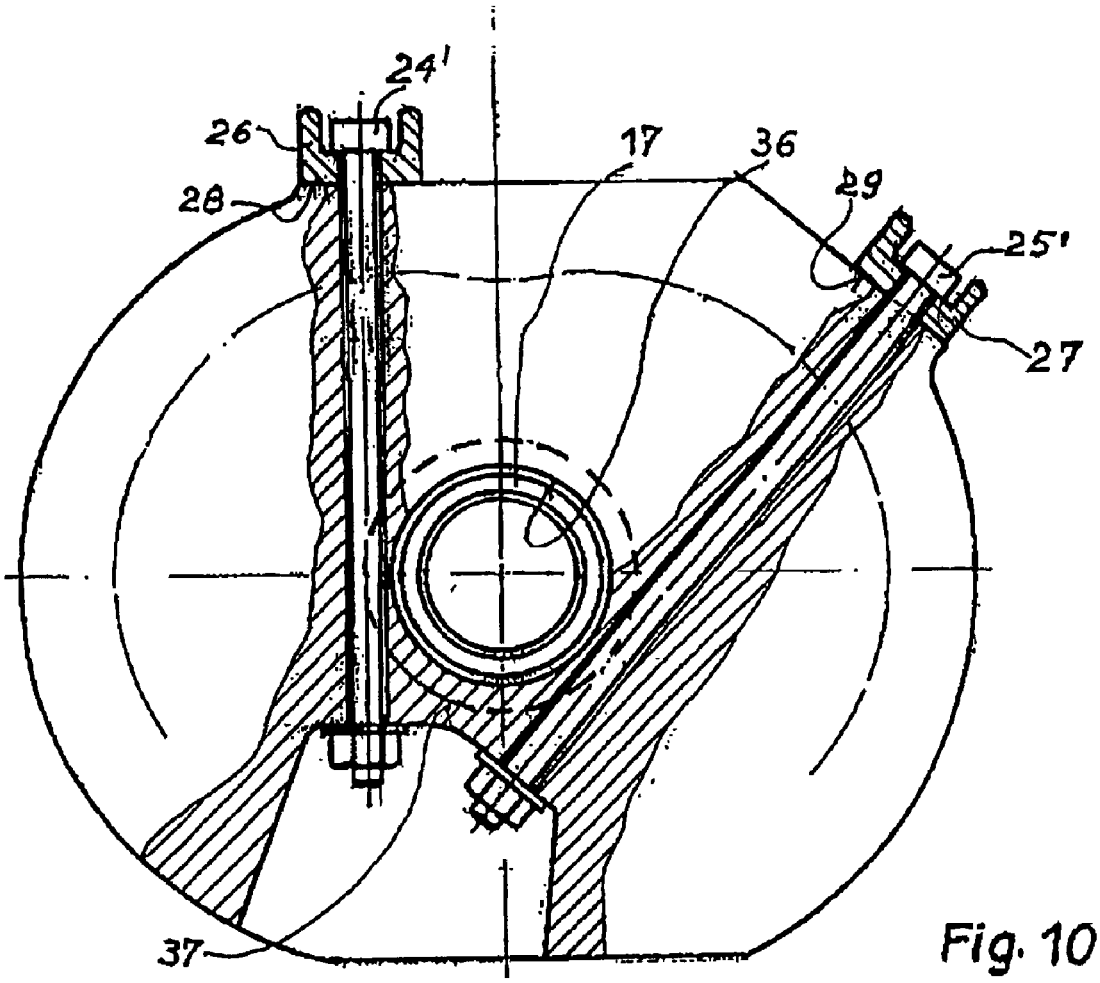
FIG. 10 is a partially cut view of a side part with two continuous tie rods, which run tangentially past the bearing body.

The embodiment, according to FIG. 10, differs from the previous embodiments in that the two tension bolts 24', 25' are not connected directly to the bearing carrier body 17, but rather run tangentially past it. The tension bolts 24', 25' are pushed through boreholes of the side part and secured by nuts and washers. The two tension bolts 24' and 25' hold the bearing carrier body, installed axially in a borehole 36 of the side part, over the area 37 of the side disks located in between.

In all of the embodiments the length of the segmental elements 26, 27 is adapted to the number of housing parts. The contact surfaces 28, 29 serve as the basis for centering the bearing bodies 17, 17', 18, 31.

In all of the illustrated embodiments, two tension bolts have been provided for the side parts. It has the advantage that a force introduction in the region of high gas pressures is maintained that can vary somewhat as a function of the operating conditions. However, it is also possible to provide only one tension bolt between the bearing carrier bodies and the outer support elements. That is, said tension bolt is then arranged as exactly as possible in the direction of the line of the main force effect, that is in the direction of the double arrow 14 of FIG. 1.

The bearing bodies and the support elements are made of steel or gray cast iron. High strength steel screws are used for the tension bolts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotary piston engine in trochoidal design comprising:

a light metal rotor housing;

at least one light metal side part;

an eccentric shaft;

a bearing body that is disposed in the side part for receiving the eccentric shaft, the bearing body having an area of maximum gas pressure;

at least one tie rod holding the bearing body's area of maximum gas pressure, the tie rod being oriented approximately radially in relation to the bearing body; and a support element resting on the side part and the rotor housing and being connected to each tie rod.

2. The rotary piston engine of claim 1, comprising at least two tie rods for the bearing body, one of the tie rods being disposed approximately in a plane of symmetry of the rotor housing and the other tie rod being disposed at an angle ranging from approximately 30 degrees to approximately 45 degrees from the plane of symmetry in the direction of rotation.

3. The rotary piston engine of claim 2, wherein the tie rods are aligned parallel to each other.

4. The rotary piston engine of claim 1, comprising two side parts between which the rotor housing is disposed, wherein the tie rod includes a tension bolt that extends through the side parts.

5. The rotary piston engine of claim 1, comprising two side parts between which the rotor housing is disposed, and two bearing bodies disposed in the side parts, respectively, wherein the bearing bodies each have a partially cylindrical outer surface and are held on counter-surfaces of the side parts by the tie rods.

6. The rotary piston engine of claim 5, wherein an outer surface of each bearing body has a configuration that is from approximately one-third to approximately one-half of a total cylinder surface.

7. The rotary piston engine of claim 5, wherein the support elements for the tie rods are connected.

8. The rotary piston engine of claim 7, wherein the support elements for all of the tie rods form one integral component.

9. The rotary piston engine of claim 8, wherein the support elements serve as centering elements for the bearing bodies.

10. The rotary piston engine of claim 9, wherein the support elements rest on a surface that is approximately concentric to the axis of the bearing bodies.

11. The rotary piston engine of claim 9, wherein the support elements rest on surfaces tangentially to the axis of the bearing bodies.

12. The rotary piston engine of claim 1, wherein the bearing body comprises at least two parts.

13. The rotary piston engine of claim 1, wherein contact surface of the bearing body in the side part comprises a parallel straight line in relation to an outermost contact surfaces.

14. The rotary piston engine of claim 1, comprising an additional tie rod arranged in the direction of rotation of the plane of symmetry of the rotor housing up to an angle of approximately 90 degrees.

15. The rotary piston engine of claim 1, wherein the tie rod runs tangentially past the bearing body.

16. The rotary piston engine of claim 1, wherein the at least one tie rod is threadedly received in the bearing body's area of maximum gas pressure and pushes the bearing body and the support element towards each other.

17. A method of making a rotary piston engine in trochoidal design, the engine including a light metal rotor housing, at least one light metal side part, an eccentric shaft and a bearing body that is disposed in the side part for receiving the eccentric shaft, the bearing body having an area of maximum gas pressure, the method comprising:

using at least one tie rod to hold the bearing body's area of maximum gas pressure;

orienting the tie rod approximately radially in relation to the bearing body; and connecting a support element, which rests on radially external surfaces of the side part and rotor housing, to the tie rod.

18. The method of claim 17, comprising:

disposing the tie rod approximately in a plane of symmetry of the rotor housing; and disposing a second tie rod at an angle ranging from approximately 30 degrees to approximately 45 degrees from the plane of symmetry in the direction of rotation.

19. The method of claim 18, comprising connecting the support elements.

20. The method of claim 17, comprising disposing the rotor housing between two side parts, and extending a tension bolt through the side parts.

21. The method of claim 17, wherein the at least one tie rod is threadedly received in the bearing body's area of maximum gas pressure and pushes the bearing body and the support element towards each other.

* * * * *